US008506252B1

(12) United States Patent
Liang

(10) Patent No.: US 8,506,252 B1
(45) Date of Patent: Aug. 13, 2013

(54) TURBINE BLADE WITH MULTIPLE IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 529 days.

(21) Appl. No.: 12/909,345

(22) Filed: Oct. 21, 2010

(51) Int. Cl.
*F01D 5/18* (2006.01)

(52) U.S. Cl.
USPC ..... 416/97 R; 416/90 R; 416/92

(58) Field of Classification Search
USPC ..... 416/90 R, 92, 96 R, 96 A, 97 R; 415/115
See application file for complete search history.

(56) References Cited

U.S. PATENT DOCUMENTS 5,704,763 A * 1/1998 Lee ..... 416/96 R
6,554,571 B1 * 4/2003 Lee et al. ..... 416/92
6,955,525 B2 * 10/2005 Liang ..... 416/97 R

* cited by examiner

*Primary Examiner* — Christopher Verdier
(74) *Attorney, Agent, or Firm* — John Ryznic

(57) ABSTRACT

A turbine rotor blade with a cooling air channel formed in a mid-chord region, the channel includes a number of rows of semi-circular shaped ribs that extend across the channel and open toward the blade tip. Adjacent ribs form metering and impingement passages that discharge a jet of cooling air against the rib above it. The open ends of the ribs form vortex generating passages in which the impingement cooling air flows into to form a vortex flow pattern in the cooling air.

5 Claims, 5 Drawing Sheets

TURBINE BLADE WITH MULTIPLE IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream. In some engines, cooling is even required in the third stage turbine blades of an IGT engine. However, the cooling requirement for the third stage blade is much less than the first and second stage blades. Some cooling is required in order to extend the life of the blade.

FIG. 1 shows a third stage turbine rotor blade for a large IGT engine will circular shaped pin fins 11 that extend across a cooling flow channel formed between the pressure and suction side walls of the mid-chord region of the airfoil. The pin fins 11 enhance the mid-chord region cooling channel internal heat transfer coefficient by 1.5 to 2 times that of an open flow channel. FIG. 2 shows a section of the pin fins 11 with cooling air flow.

FIG. 3 shows pin fins 21 having a race track shape instead of the circular shape of FIG. 2. The race track shaped pin fins will further improve the internal heat transfer performance over the circular shaped pin fins. FIG. 4 shows the cooling air flow pattern through the rows of circular pin fins 11. As the cooling air flows through the pin fin 11 bank, a turbulence level for the cooling air will gradually increase and results in an increase of the internal cooling heat transfer performance.

FIG. 5 shows the cooling air flow through the rows of race track shaped pin fins 21. As seen in FIG. 5, the race track shaped pin fins 21 provide for the cooling air flow to hit directly onto the surface of the next downstream pin fin 21. The race track shaped pin fins 21 produce a higher resistance for the cooling air flow through the pin bank compared to the circular shaped pin fins 11. The cooling air flow path becomes more tortuous. A higher turning or higher momentum change for the cooling air in-between pin fin 21 rows is produced. The overall turbulence level is increased and thus the internal heat transfer performance of the cooling air.

BRIEF SUMMARY OF THE INVENTION

A turbine rotor blade with an internal cooling air flow channel in the mid-chord region in which rows of semi-circular ribs extend across the flow channel in a staggered arrangement to produce multiple impingement with vortex flow cooling for the airfoil. Adjacent semi-circular ribs form cooling air passages that produce impingement jets of cooling air that discharge against downstream semi-circular ribs to produce impingement cooling. The semi-circular ribs open upward so that the cooling air passing through the impingement jets will form a vortex flow pattern within the open sections of the semi-circular ribs. The semi-circular ribs extend from the platform of the airfoil to the tip and provide cooling along the entire mid-chord section of the blade.

DETAILED DESCRIPTION OF THE INVENTION

Figure 1:
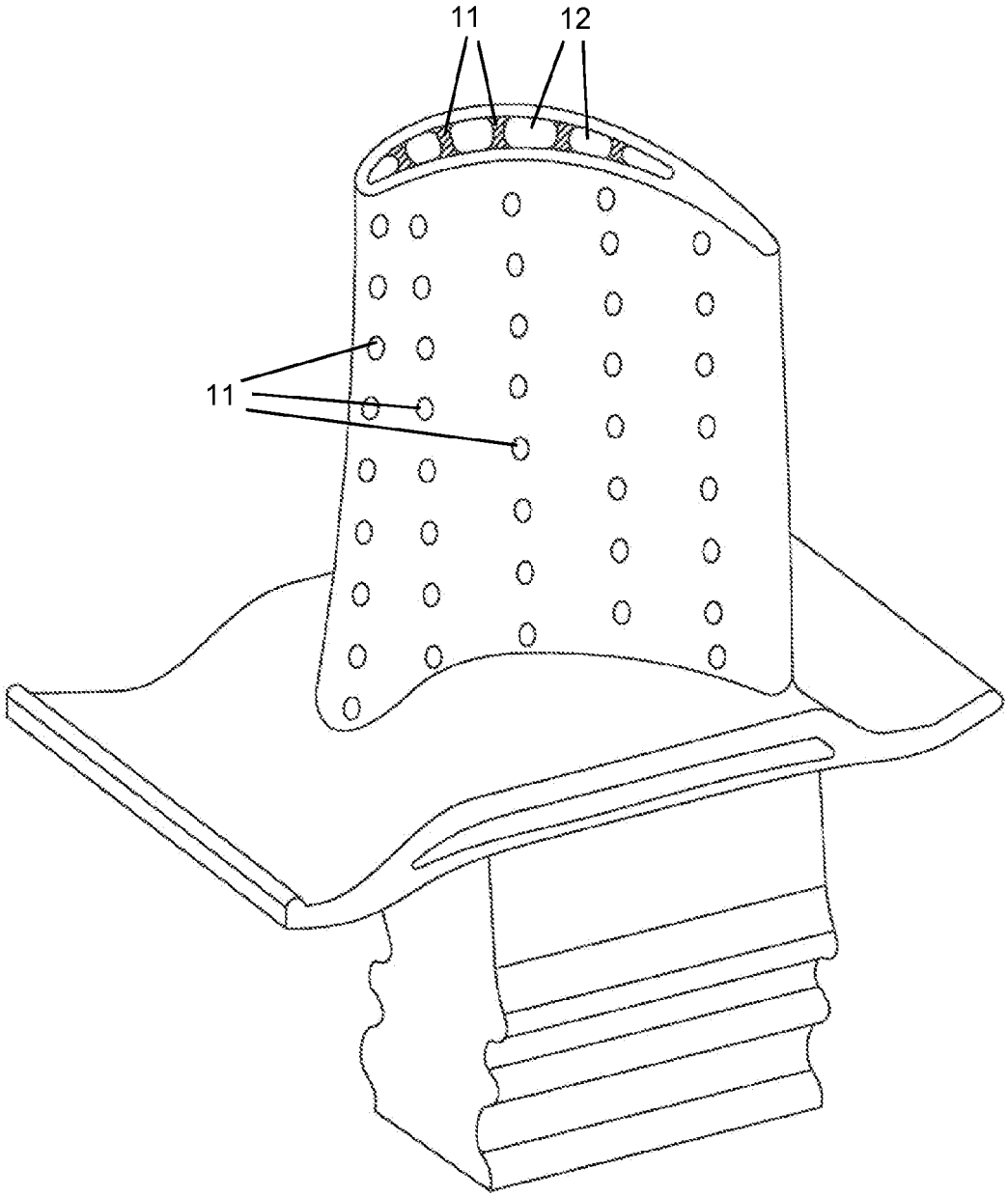
Fig 1 prior art
FIG. 1 shows a schematic view of a prior art turbine rotor blade with a pin bank formed by rows of circular shaped pin fins.
Figure 2:
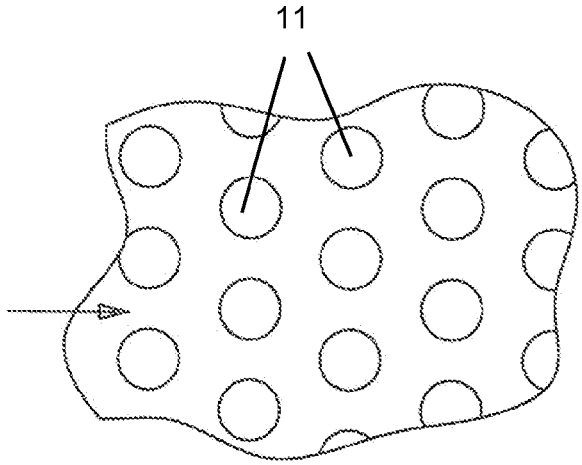
Fig 2 prior art
FIG. 2 shows a cross section view of a section of the circular shaped pin fins of FIG. 1.
Figure 3:
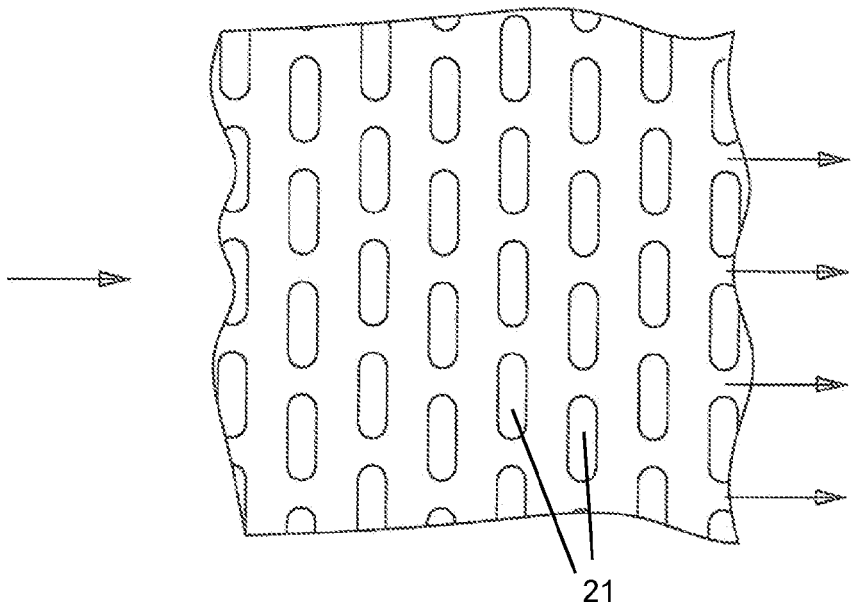
Fig 3 Prior Art
FIG. 3 shows a cross section view of a bank of pin fins that have a race track cross section shape.
Figure 4:
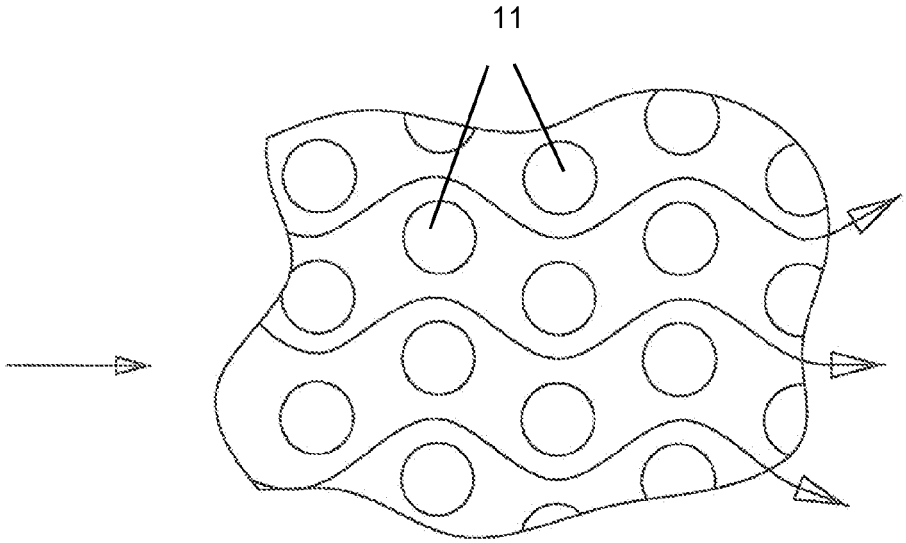
Fig 4 prior art
FIG. 4 shows a bank of pin fins of the circular shape with the cooling air flow pattern through the bank.
Figure 5:
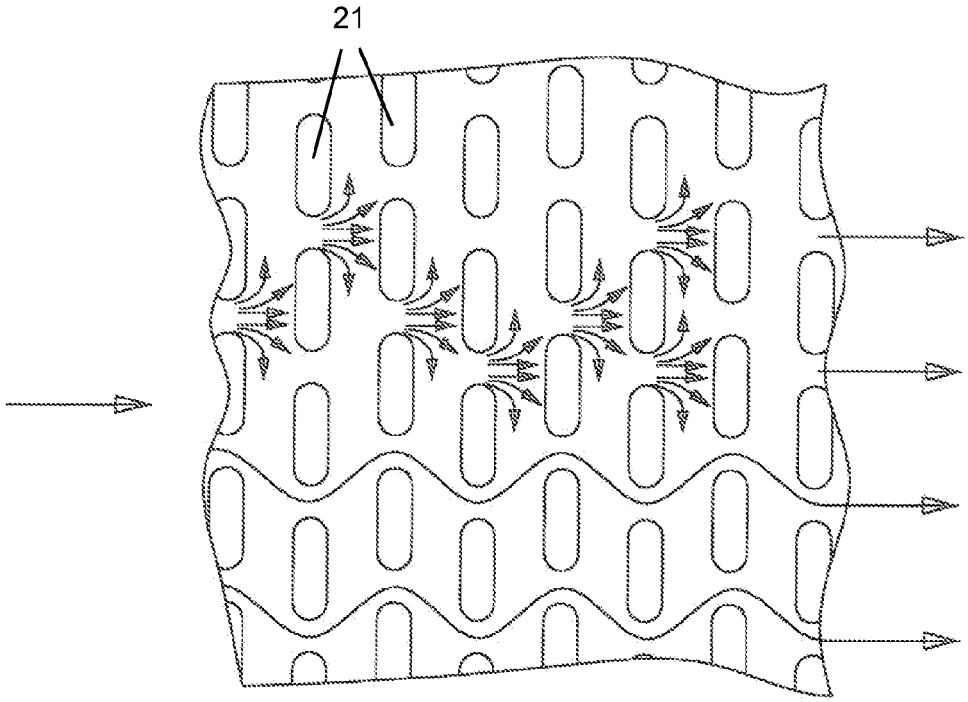
Fig 5 Prior Art
FIG. 5 shows a bank of pin fins of the race track shape with the cooling air flow pattern through the bank.
Figure 6:
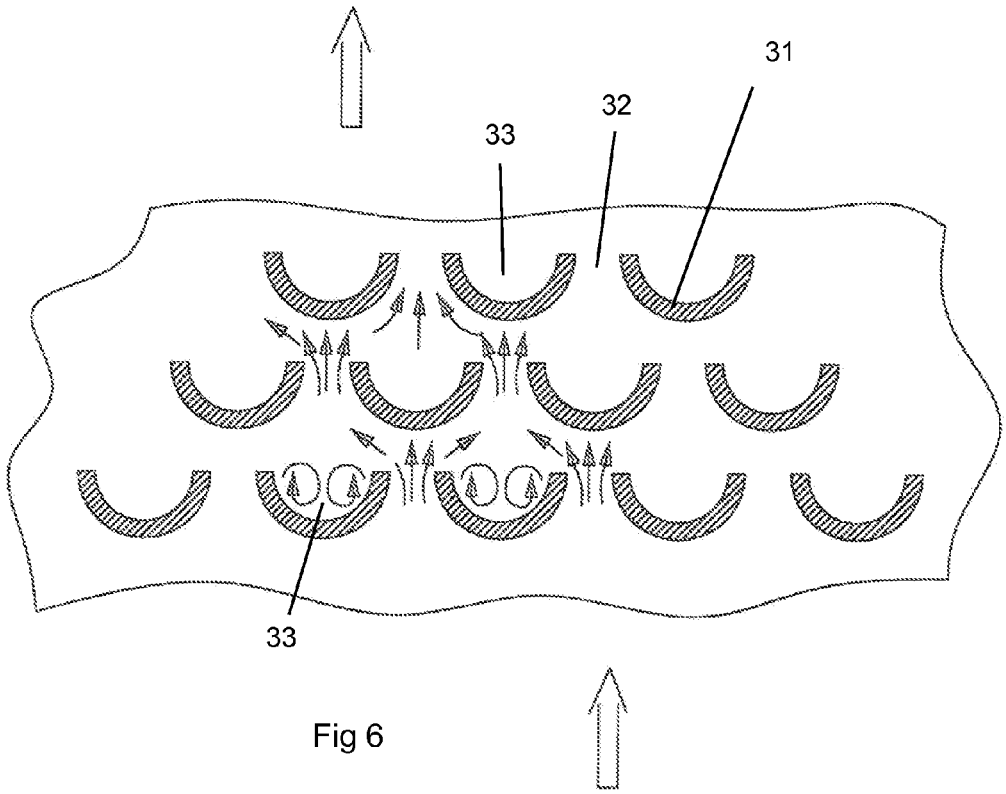
FIG. 6 shows a cross section view of a section of the pin bank of the present invention with semi-circular shaped pin fins.
Figure 7:
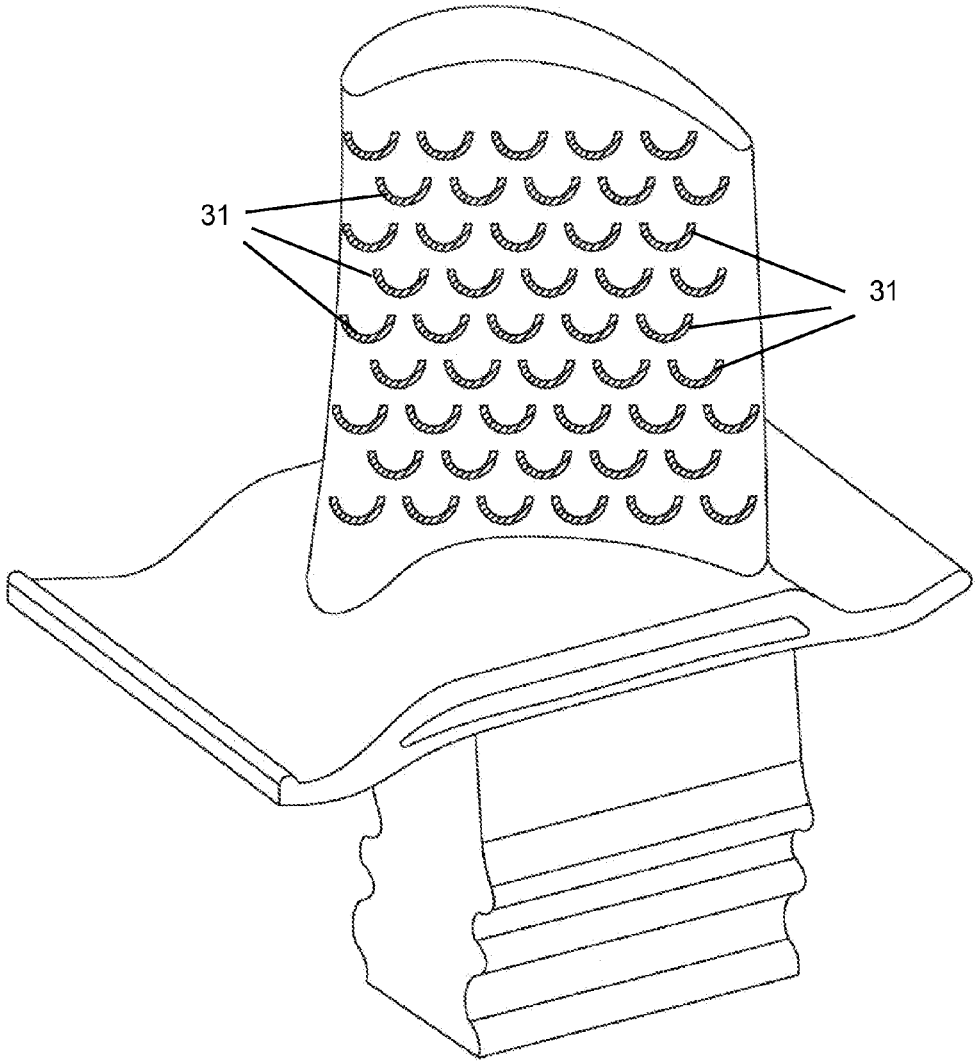
FIG. 7 shows a schematic view of the blade of the present invention with the pin bank of the semi-circular pin fins of the present invention.

The turbine rotor blade of the present invention is shown in FIGS. 6 and 7 in which the blade includes a cooling air channel in the mid-chord region with a number of rows of semi-circular shaped ribs 31 extending in a chordwise direction and across the cooling air channel from the pressure side wall to the suction side wall to form a series of impingement cooling and vortex flow passages from the blade platform to the blade tip for cooling of the blade. FIG. 6 shows a section of the semi-circular ribs 31 that open upward toward the blade tip. The ribs 31 form metering and impingement holes or passages 32 in-between that produce an impingement jet of cooling air. The rows of ribs 31 are offset so that the impingement jet will be directed against the bottom of the next semi-circular rib 31. The ribs 31 extend from the pressure side wall of the cooling channel to the suction side wall of the cooling channel.

The ribs 31 open upward and form a vortex flow chamber 33 in the open section of the ribs in which the cooling air flowing through the metering and impingement passage 32 will form a vortex flow pattern of the cooling air as seen in FIG. 6. The vortex flow pattern will further increase the over-all heat transfer coefficient for the cooling air. FIG. 7 shows the turbine blade with the rows of semi-circular ribs 31 of the present invention.

The semi-circular ribs 31 are cast into the blade during the blade casting process. A size of the metering and impingement passages 32 can be sized depending on the cooling air flow required and other design requirements. The cooling air metering and impingement flow with the vortex flow within the open ends of the ribs will create high coolant flow velocities and high internal heat transfer while the multiple impingement yield high overall cooling effectiveness for the blade.

In operation, cooling air flows through the root section and into the radial flow channel between the walls of the blade. The cooling air flow can be distributed based on the airfoil chordwise metal temperature requirement. Partition ribs can be used to sub-divide the mid-chord radial flow channel into multiple radial flow channels. The inter-spacing between each vortex chambers 33 will provide an impingement jet flow path for the coolant parallel to the spanwise direction of the gas path pressure and temperature profiles. The cooling air flow can be distributed based on the airfoil spanwise metal temperature requirement by varying the spacing of the metering and impingement passage 32. In general, the vortex chambers 33 create high coolant flow velocities and high internal heat transfer while the impingement flow path yields high overall cooling effectiveness. The impingement process for the cooling air repeats throughout the entire cooling passage and is then discharged from the airfoil tip section. A row of exit holes or slots along the trailing edge or the trailing edge region (opening on the pressure side wall) can be used to further cooling the blade in this region.

I claim the following:

1. A turbine rotor blade comprising:

an airfoil extending from a platform;

the airfoil having a pressure side wall and a suction side wall with a cooling air channel extending from the platform to a blade tip;

a plurality of rows of ribs extending along a chordwise direction of the blade and across the cooling air channel;

the ribs having a concave shape with an open end facing toward the blade tip;

adjacent ribs in a row forming a metering and impingement passage; and, adjacent rows of ribs being staggered such that a metering and impingement passage is located around a center of a concave rib directly above the metering and impingement passage.

2. The turbine rotor blade of claim 1, and further comprising:

the ribs extend across a mid-chord section of the blade from the platform to the blade tip.

3. The turbine rotor blade of claim 1, and further comprising:

the ribs and the metering and impingement passages are shaped to form a vortex flow within the open end of the ribs.

4. The turbine rotor blade of claim 1, and further comprising:

the ribs are half circular in shape.

5. The turbine rotor blade of claim 1, and further comprising:

the ribs extend across the cooling air channel from the pressure side wall to the suction side wall.

* * * * *